US005924914A

United States Patent [19]

Engh

[11] Patent Number: 5,924,914

[45] Date of Patent: Jul. 20, 1999

[54] ROTARY CUTTER HEAD KNIFE JOINTER

[76] Inventor: Harry W. Engh, Box 134, Omak, Wash. 98841

[21] Appl. No.: 08/897,730

[22] Filed: Jul. 21, 1997

[51] Int. Cl.[6] ..... B24B 7/00

[52] U.S. Cl. ..... 451/164; 451/419; 451/423

[58] Field of Search ..... 451/419, 423, 451/48, 164

[56] References Cited

U.S. PATENT DOCUMENTS

| | | | |
|---|---|---|---|
| 267,579 | 11/1882 | Palmer . | |
| 993,398 | 5/1911 | Osborn . | |
| 2,476,177 | 10/1949 | Bloom . | |
| 2,620,606 | 10/1952 | Dvorak . | |
| 2,788,623 | 4/1957 | Procter | 51/246 |
| 2,864,210 | 12/1958 | Mann | 51/246 |
| 3,374,699 | 3/1968 | Schmermund . | |
| 3,683,564 | 8/1972 | Lawrence | 51/249 |
| 3,738,067 | 6/1973 | Smith | 51/249 |
| 4,321,773 | 3/1982 | Fleming | 51/249 |
| 4,495,734 | 1/1985 | Rauch . | |
| 4,603,513 | 8/1986 | Murphy | 51/250 |
| 4,739,588 | 4/1988 | Engh | 51/246 |
| 5,159,784 | 11/1992 | Varner, Sr. et al. | 51/173 |
| 5,172,521 | 12/1992 | McClure et al. | 51/57 |
| 5,727,991 | 3/1998 | Main | 451/48 |

*Primary Examiner*—David A. Scherbel
*Assistant Examiner*—Dung Van Nguyen
*Attorney, Agent, or Firm*—Wells, St. John, Roberts, Gregory & Matkin

[57] ABSTRACT

A rotary cutter head knife jointer is disclosed, in which a rigid base is adapted for mounting in a fixed position adjacent a rotary cutter head. The jointer includes a first carriage and a first guide that mounts the first carriage to the rigid base for translational movement along a first prescribed path. A second carriage is mounted to the first carriage and includes a jointing stone holder and a bolster plate. A second guide member mounts the bolster plate to the first carriage for translational movement along a second prescribed path. The second guide member includes a pair of parallel elongated guide bars that are mounted between the first carriage or bolster plate, to define the second prescribed path. A pair of guide bar engaging members are located on one or both of the first carriage and bolster plate. A bushing plate slidably engages the bolster plate, and a plurality of spring biasing members are positioned between the bushing plate and first carriage, to movably hold the bushing plate against the bolster plate and the guide bar engaging members.

19 Claims, 10 Drawing Sheets

29
10
12
16
22
28
18
26

68
T1
T2
30
40
34
66
42
70
72
52
20
78
64
32
75
52
36
76
80
50
74
82
60
54
62
58
56

10
12
16
29
26
28
68
22
66
T1

70
12
18
75
32
72
82
52
34
74
76
52
80
36
78
54
42
52
62
64
56
60

ROTARY CUTTER HEAD KNIFE JOINTER

TECHNICAL FIELD

The present invention relates to apparatus for jointing cutter knives or the type used in rotary cutter heads, particularly in wood working fields.

BACKGROUND OF THE INVENTION

Surfacing machines, such as wood planers and jointers, etc., often make use of at least one powered, rotatable cutter head. The cutter head is typically supplied with a number of axial knives presenting sharpened edges along the outward periphery of the cutter head for removing material passed over the rotating head on a workpiece support surface. In wood planers, often two or more such cutter heads are used to simultaneously perform surfacing operations on opposing surfaces of the wooden workpiece.

The process involved in mounting the cutter knives to rotatable cutter heads is rather complicated and time consuming. It is therefore desirable to periodically recondition or "joint" the knives on the cutter head rather than removing the knives and sharpening each separately.

Proper equipment used in the jointing operation and correct selection of jointing stones are major assets in accomplishing a proper jointing operation.

A skilled worker may have adequate training and expertise to accomplish a quality job, but may well be frustrated in doing so because of equipment shortcomings. For example, a soft jointing stone is almost always preferred over a hard, dense stone. But the soft stones cannot be used due to the pounding action of the rotating knives against the stone if the stone support "flutters." This is a typical situation with most, if not all, present "dovetail" jointer stone support assemblies. A worn or loose fit in the stone support allows the stone support to jump or "flutter" as the knives rotate into engagement with the stone. Soft stones are easily broken in this situation so the less desirable hard stones must be selected.

Another result of the stone support flutter is that an undesirable high or outwardly projecting "heel" is created behind the cutting edge of the knives. This excessive "heel" does not assist the knives in the cutting or scraping operation, but instead rubs over the surface of the workpiece, often causing burns or, at best, a damaged textured surface. Nonetheless, the worker must select a hard stone for the jointing process since a soft stone would be surely broken by the fluttering action of the support and contact with the surfacer knives.

A tight or securely mounted stone holder will facilitate the use of softer stones which remove many times more material in a shorter time. However, the presently available jointer devices cannot be effectively "tightened" to provide firm support for the stone without sacrificing freedom of movement for the stone across the cutter head during the jointing operation. Dovetail stone mounts will not slide freely when secured in a manner sufficient to reduce or eliminate stone flutter. Older, worn jointing devices simply cannot be adjusted tight enough to accomplish the task, with the inherent sacrifice of mobility of the stone across the cutter head.

The above problems have been recognized to limited degree by the below-referenced United States patents. However, it is not believed that any of the known references show or suggest the solution embodied in the present invention as set forth below.

U.S. Pat. No. 4,495,734 granted to Rauch in 1985 discloses a grinding arrangement for chopping cutters. The grinding arrangement makes use of a tool mounting bar and guide slidably engaged thereon for supporting the grinding stone. A wheel actuator arrangement is provided for driving and guiding the stone to and fro along the axial length of the cutter head. This arrangement, while making use of wheels in the drive arrangement, still makes use of a singular bar and guide way arrangement for mounting the grinder.

U.S. Pat. No. 3,374,699 to Schmermund discloses a sharpening arrangement for mounting cutter heads and for sharpening the cutter heads. The apparatus includes a support frame for receiving and mounting the cutter head for rotation on an axis that is skewed in relation to a grinding tool support. The grinding tool is movably supported on a pair of guide rods for motion along the cutter head. A stone support is mounted on the rod-mounted carriage by a dovetail arrangement to facilitate radial adjustment of the stone against the cutter head to be sharpened.

The rods and bearings mounting the carriage and stone in the Schmermund device may function to eliminate some of the problems present in a standard dovetail guide arranged but many of these advantages may be offset by use of the dovetail stone support arrangement. It may therefore be concluded that Schmermund, while providing adequate longitudinal support for the jointing stone, teaches away from the solution presently disclosed in this application by using a dovetail stone mounting arrangement for radial adjustment relative to the blade or cutter head to be sharpened.

U.S. Pat. No. 2,476,177 to Bloom et al. issued Jul. 12, 1949, discloses a forage harvester knife sharpener. This device again makes use of an elongated bar mounting a stone holder for adjustment toward or away from the cutters on a drum. The entire mechanism is pivotal about a shaft that extends across the width of the harvester cutting head.

U.S. Pat. No. 993,398 to Osborne granted May 30, 1911, discloses a grinder for planer knives also making use of a bar slidably mounting a jointing stone support.

U.S. Pat. No. 267,579 to M. W. Palmer granted Nov. 14, 1882, discloses a planer knife grinder in which a grinding disc is mounted for rotation with an end-supported shaft adjacent a planer knife head. The powered grinding disc can be moved along the length of the rotatable single shaft by an elongated actuator extending to one side of the planer. The Palmer device is intended to sharpen each knife separately and is not a jointer cannot be used effectively with the planer in operation. A somewhat similar apparatus is disclosed in U.S. Pat. No. 2,620,606 to Dvorak, issued Dec. 9, 1952. Dvorak discloses a sharpening attachment for surfaces in which a grinding wheel is mounted by a pivoted frame to a shaft for sliding movement along the cutter head. The cutter head cannot be operated during the sharpening operation.

Of the above references, none are believed to show or suggest a solution to the problem of securing a jointing stone while enabling relatively free precision motion of the stone in relation to a rotating cutter head as described and claimed below.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
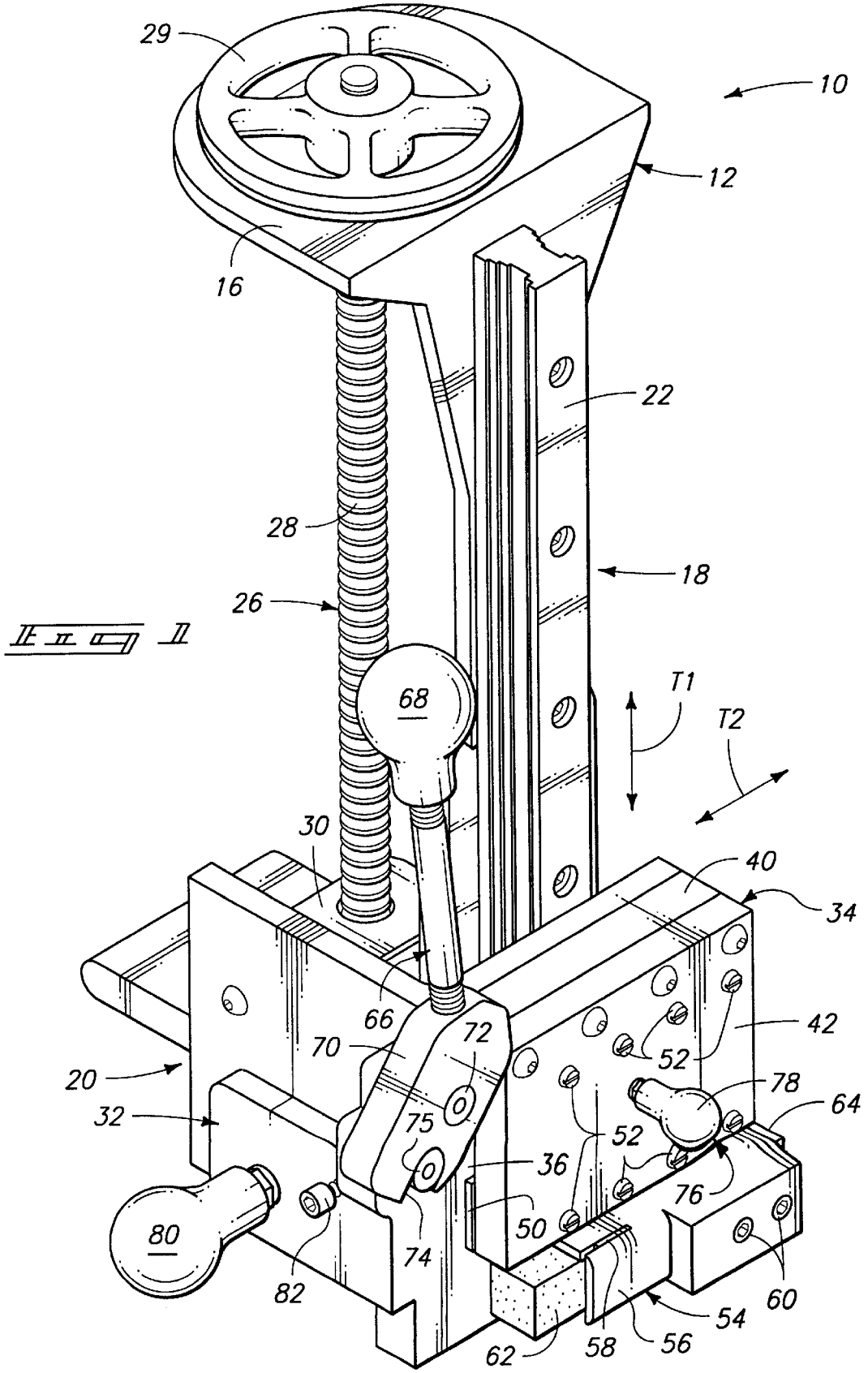
FIG. 1 is a perspective view of a first preferred form of the present invention.
Figure 2:
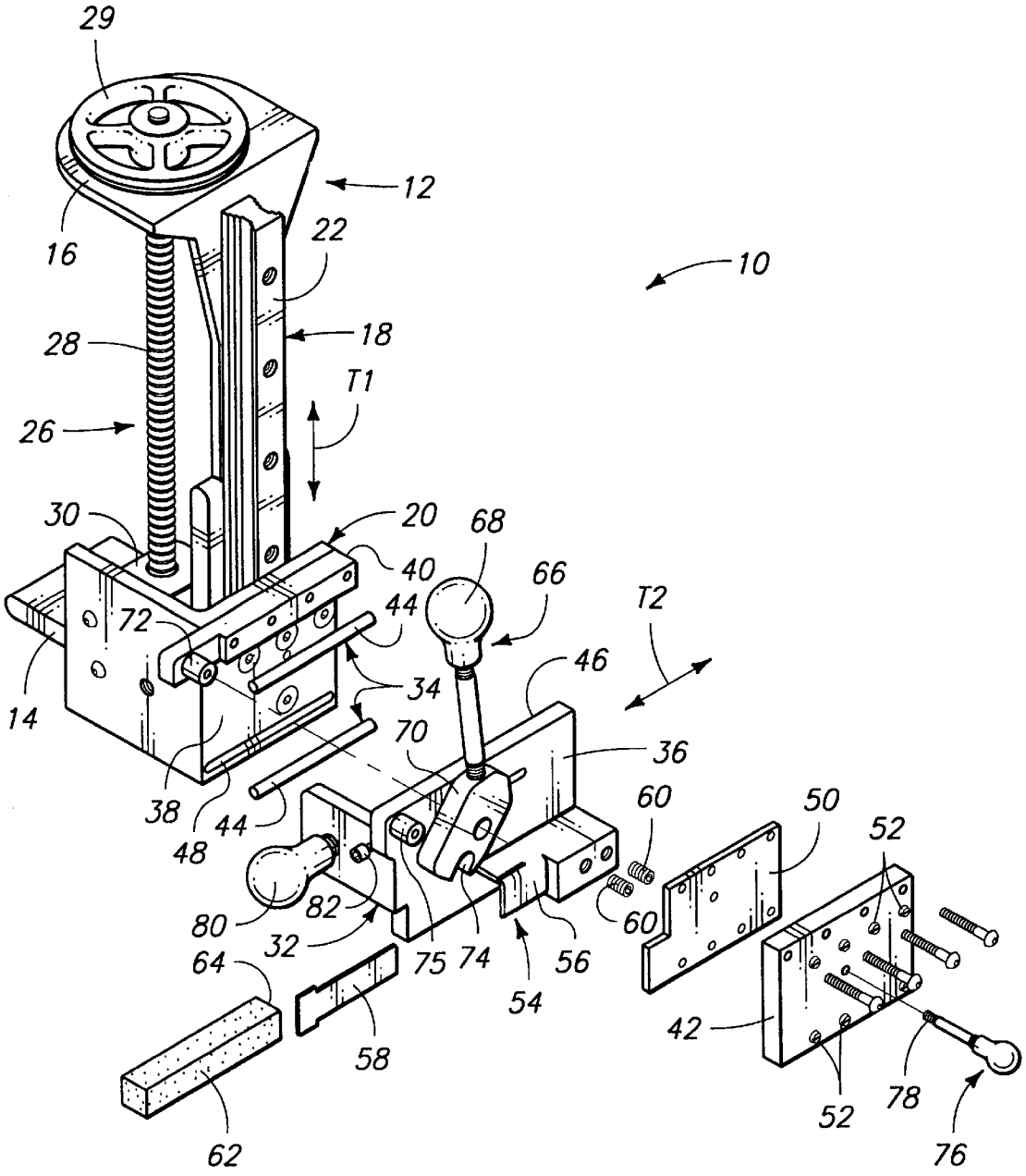
FIG. 2 is an exploded perspective view thereof.

This disclosure of the invention is submitted in furtherance of the constitutional purposes of the U.S. Patent Laws "to promote the progress of science and useful arts" (Article 1, Section 8).

A first preferred form of rotary cutter head knife jointer with improvements exemplifying the present invention is shown in the drawings and is generally designated therein by the reference numeral 10. The present invention is an improvement over my earlier patented jointer described in U.S. Pat. No. 4,739,588. Improvements in the present jointer 10 enable its use in jointing a variety of different forms of rotary cutter knives that would not be feasible with the earlier patented jointer. In particular, the present improved jointer 10 is useful in jointing side head planers of the type used to surface side edges of lumber. The same improved jointer can also be easily adapted for use with other types of rotary cutter heads, such as pattern cutters and the like.

As background and general technical reference to rotary cutter head jointing procedure, and an example of a particular rotary cutting head and cutting knives, reference is had to my U.S. Pat. No. 4,739,588. Such information is hereby incorporated by reference into the present application.

In a preferred form, the present jointer 10 includes a rigid base 12 adapted for mounting in a fixed position adjacent a cutter head (not shown). The cutter head may take any of several standard forms, all equally suited for jointing using the present jointer 10.

Figure 3:
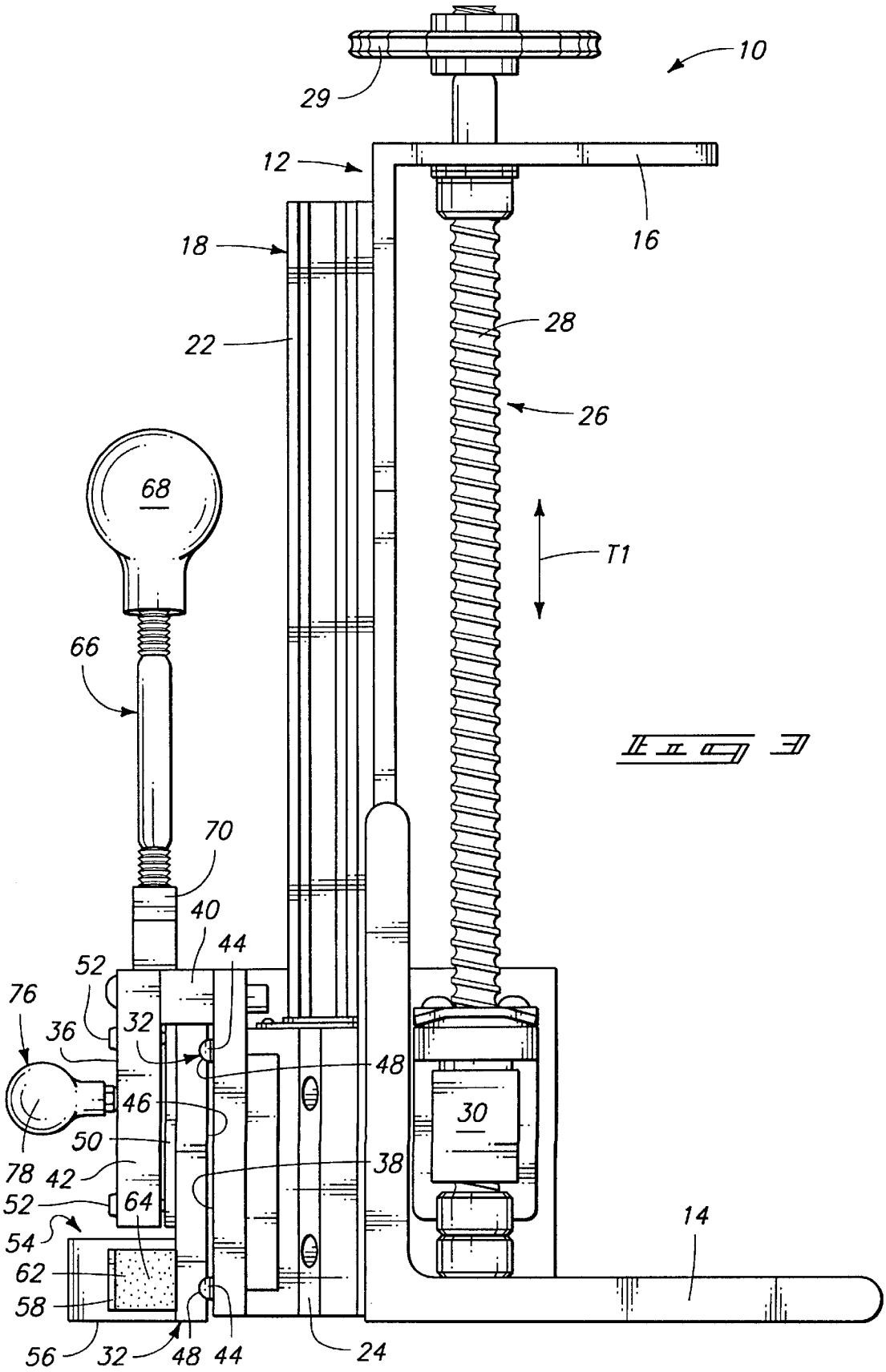
FIG. 3 is a front side elevation view thereof.
Figure 4:
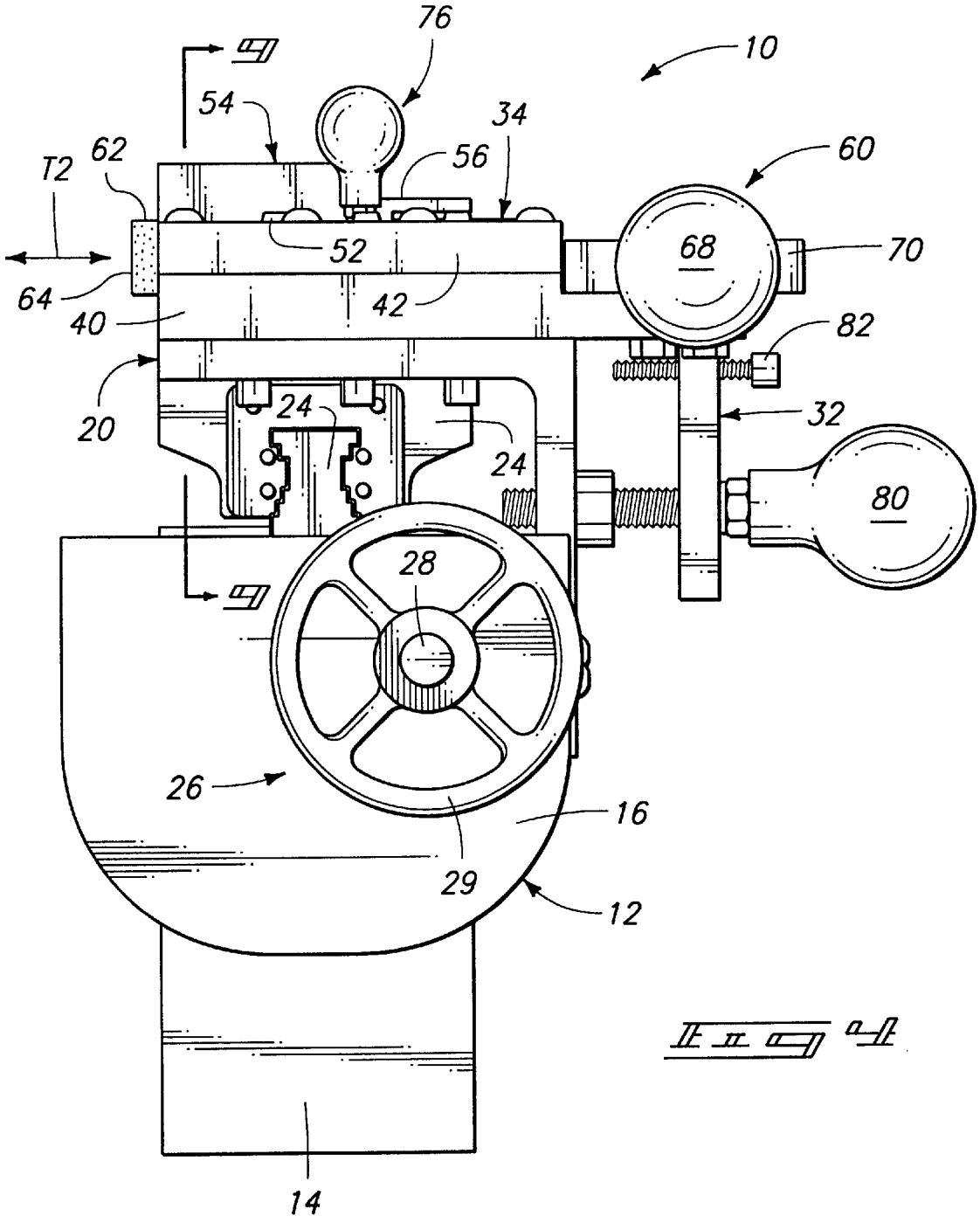
FIG. 4 is a top plan view thereof.
Figure 5:
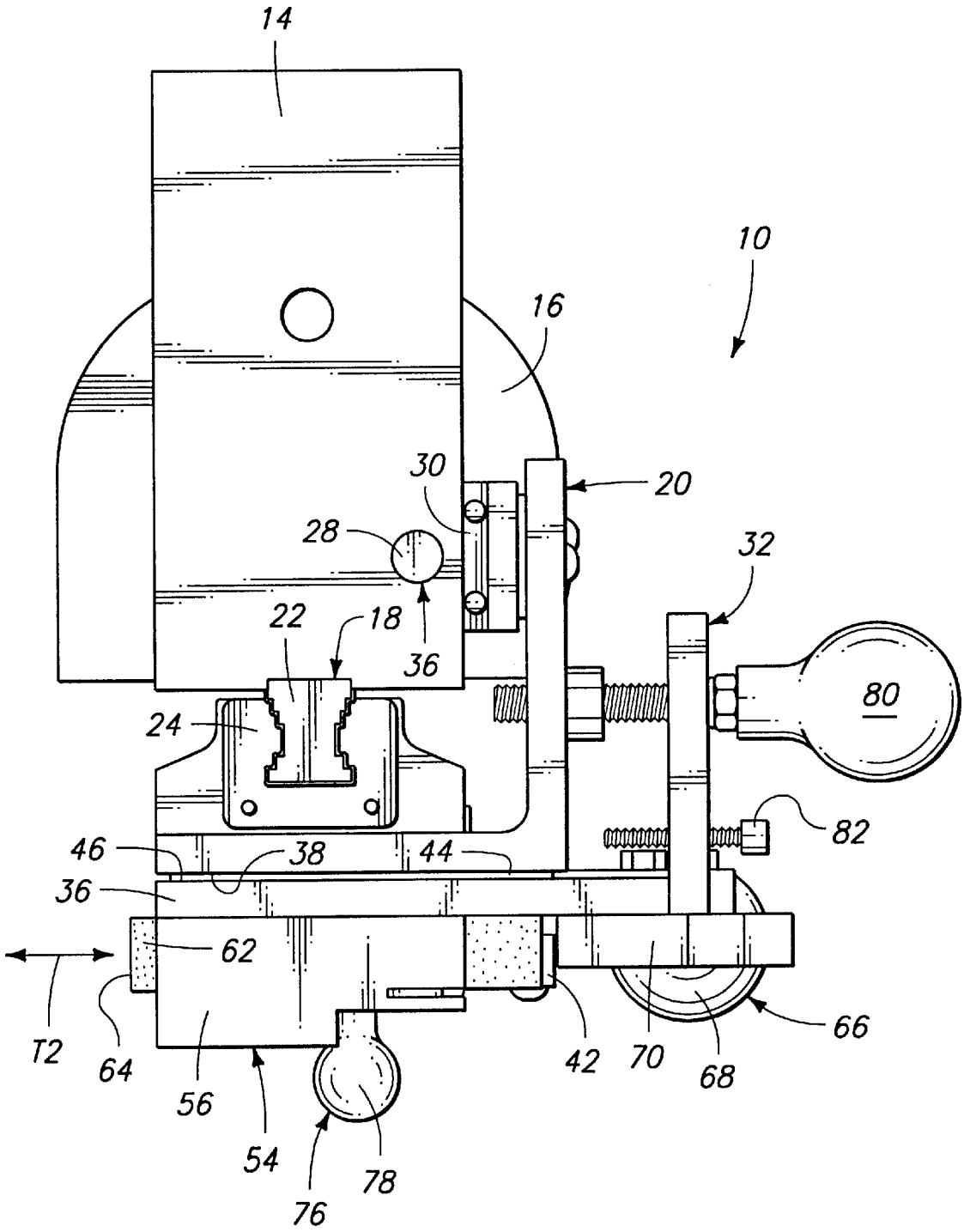
FIG. 5 is a bottom plan view thereof.
Figure 6:
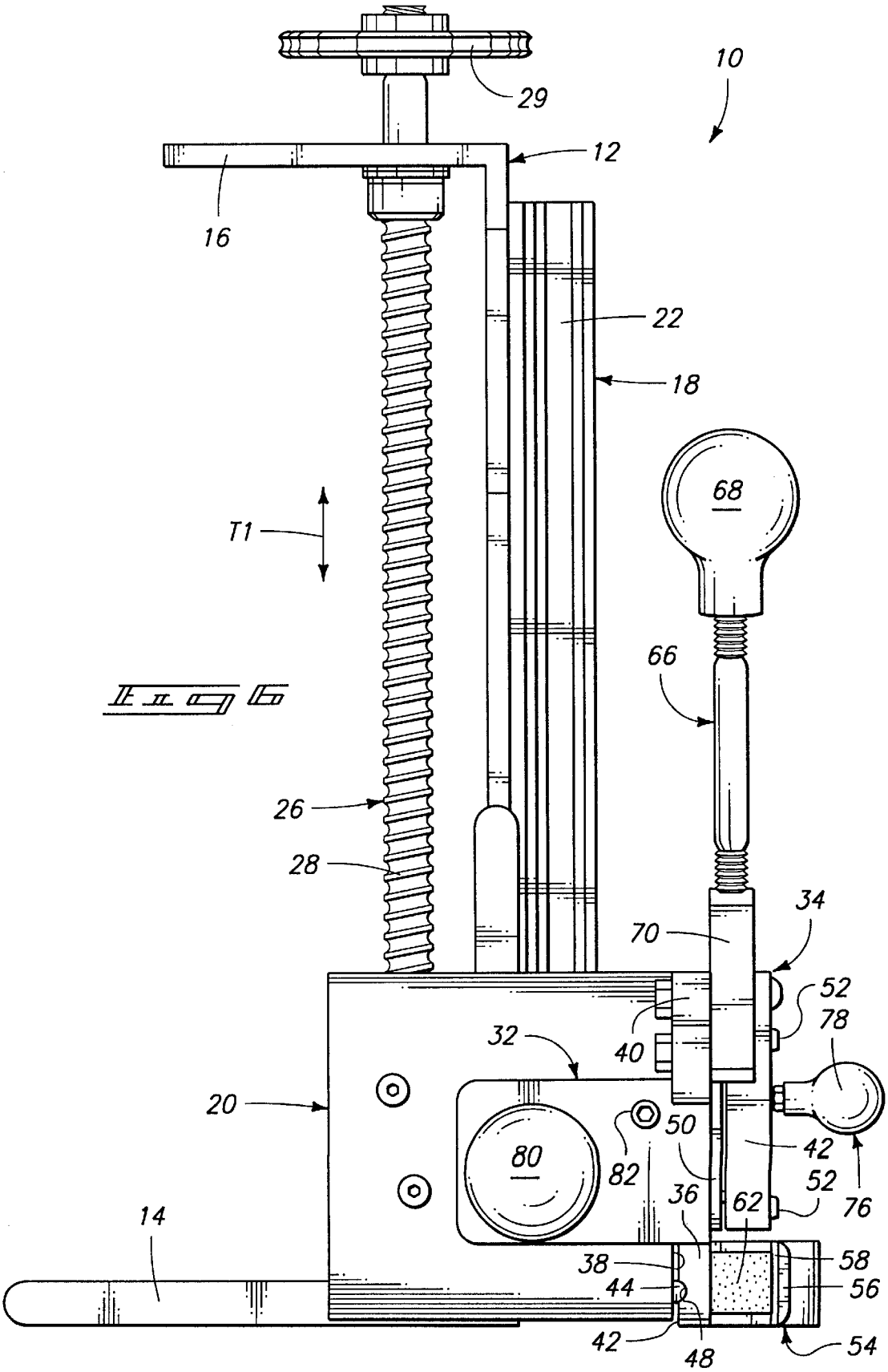
FIG. 6 is a rear side elevation view thereof, opposite the front side shown in FIG. 3.
Figure 7:
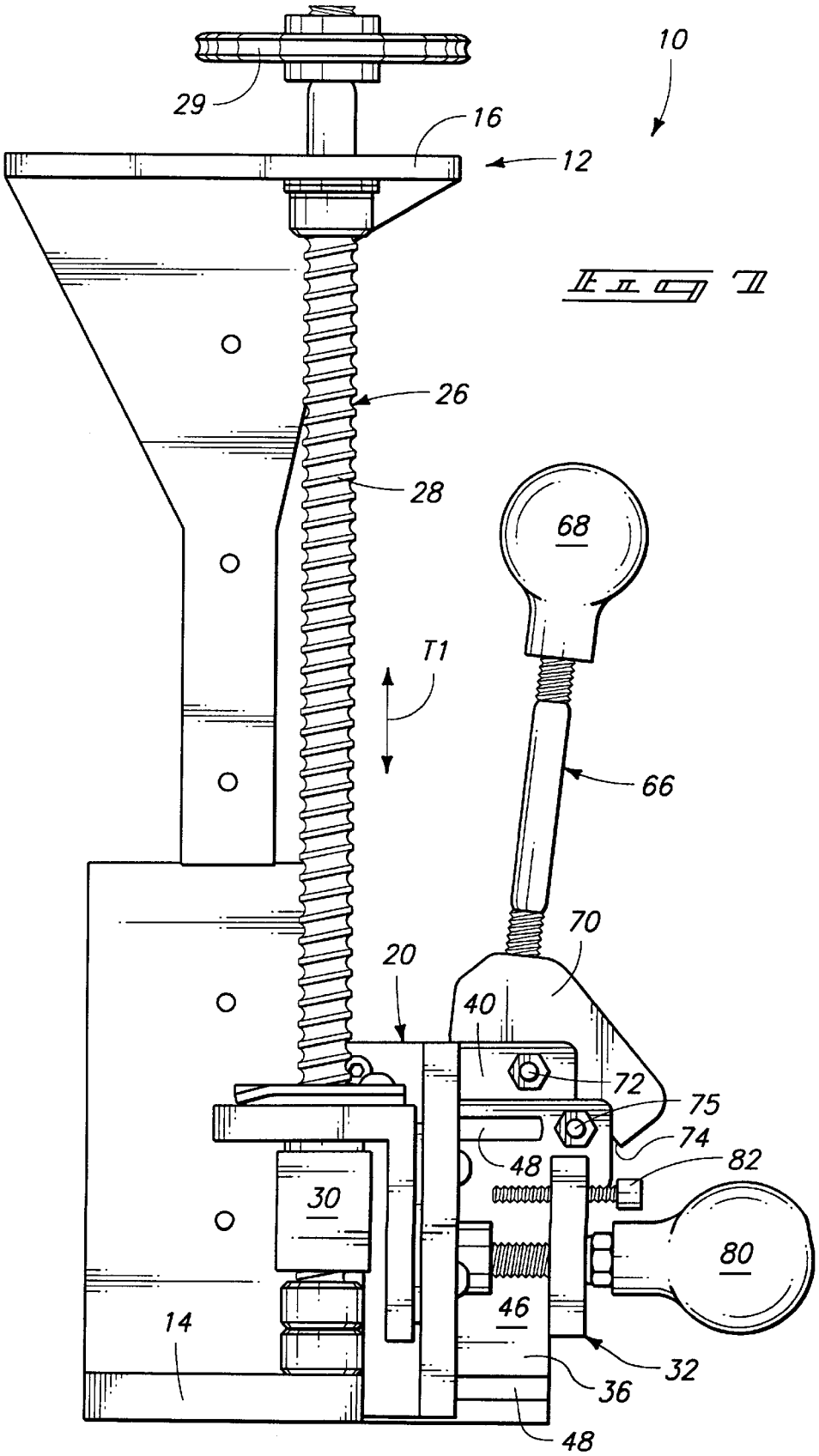
FIG. 7 is a left side elevation view thereof.
Figure 8:
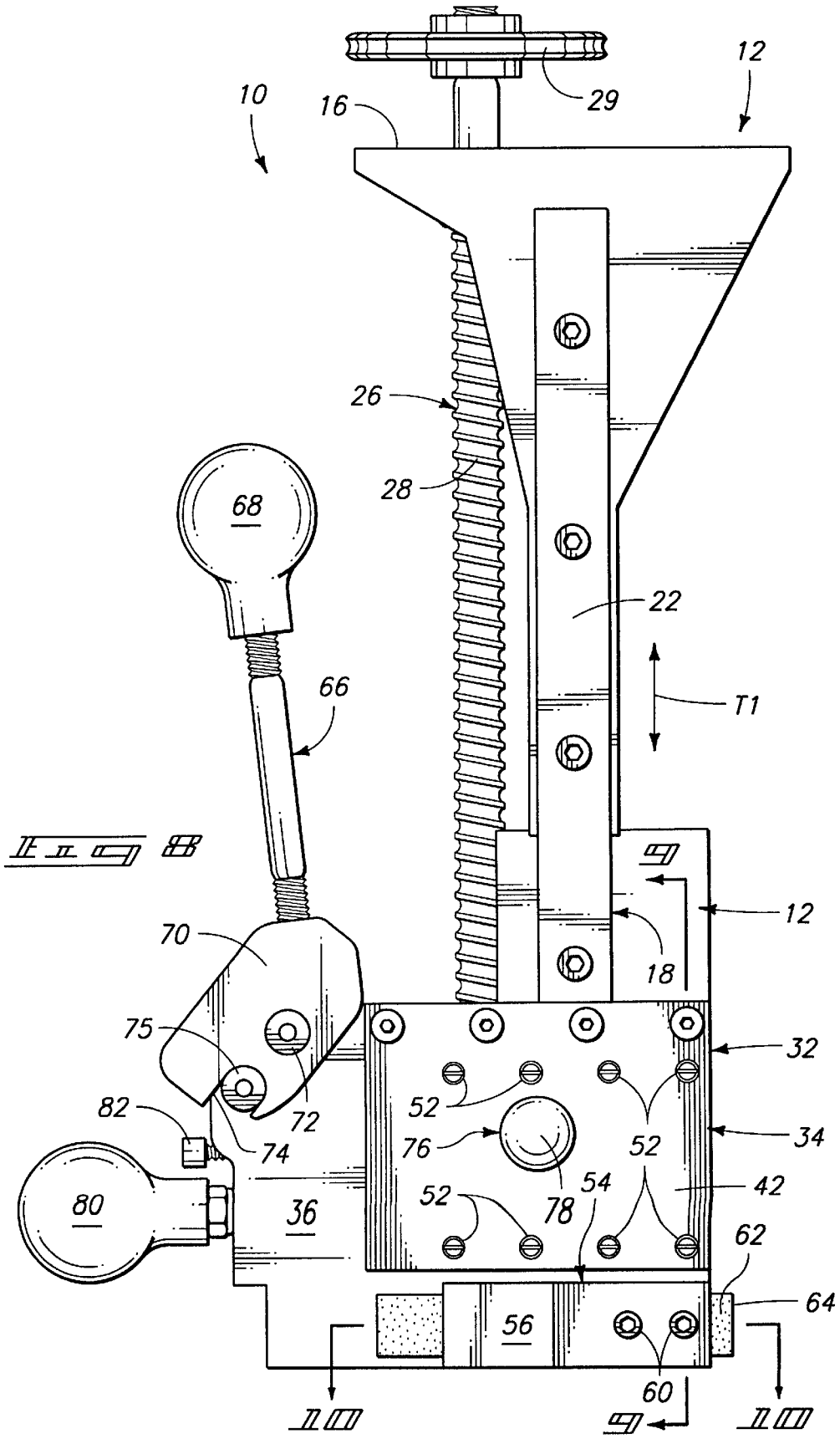
FIG. 8 is a right side elevation view thereof.

The base 12 in the first preferred form is produced from heavy angle iron pieces joined in a "C" shaped configuration (the "C" shape being clearly visible in FIG. 3) with horizontal flanges top and bottom. The bottom flange includes a foot section 14 adapted to be securely affixed to the framework of the rotary cutter adjacent the cutter head. A top flange 16 is elevationally spaced from the foot 14 to mount elements to be described later in this specification.

A first guide 18 is provided on the base 12, movably mounting a first carriage 20 to the rigid base for translational movement along a first prescribed path T1. The first path T1 is situated in a flat plane that is oriented according to the mounted position of the base 12. Preferably the path Ti is secured by the base 12, parallel to the rotational axis of the adjacent cutter head.

The first guide 18 is preferably comprised of an elongated column 22 and a linear bearing 24 movably mounted on the elongated column 22. The linear bearing is secured by bolts or other appropriate fasteners to the first carriage 20.

The column 22 is fluted longitudinally and includes opposed fillets that are shaped to receive and guide ball bearings provided in the housing of the linear bearing 24. The guide 18 is preferably a standard ball bearing linear guide form that is commercially available. The presently most preferred form is a linear ball bearing guide Model CG25AAB-P produced by Thompson Bearings Inc. of Manhasset, N.Y. It has been found that the specific guide disclosed herein is much preferred over standard "dovetail" ways often found on machining equipment, since sliding dovetails will often permit "chatter" or vibration at the jointer stone that is undesirable in jointing operations.

A first carriage positioner 26 is connected between the rigid base 12 and first carriage 20. The first carriage positioner 26 is operable to selectively position the first carriage 20 along the first prescribed path T1. The preferred positioner 26 is comprised of a lead screw 28 and a recirculating ball bearing nut 30.

The lead screw 28 is rotatably mounted by thrust bearings to the rigid base 12, between the foot 14 and top flange 16. The bearings permit rotation of the lead screw about its longitudinal axis but prevent any axial movement. The bearings also hold the lead screw parallel to the column 22. A top end of the lead screw 28 projects through the top flange 16 to mount a hand wheel 29, or a motor drive (not shown) that can be connected by appropriate belting (also not shown) to the wheel 29 for selective operation.

The recirculating ball bearing nut 30 is attached to the first carriage 20 such that rotation of the lead screw will produce resultant linear movement of the nut and first carriage along the first prescribed path T1. Recirculating ball bearings in the nut 30 engage flights of the lead screw that are formed of a semi-circular cross sectional shape, complimentary to the ball bearings. The ball bearings thus ride in the flights in close, mating engagement with the flights of the lead screw.

The particular positioner 26 shown and described above is preferred over standard screw threads and nuts since backlash quickly becomes a problem as the threads wear from frictional engagement. Backlash will translate to jointing stone "chatter" if such conventional threading is used in a rotary cutter jointer. The disclosed lead screw includes threads that are specially formed to mate intimately with the ball bearings of the nut 30 without significant backlash, and to permit smooth, positive motion of the first carriage along the first path T1 responsive to rotation of the lead screw 28. The lead screw and nut most preferred in the present jointer 10 are commercially available items identified in combination as the "Rockford Ball Screw" produced by the Rockford Ball Screw Company at Rockford, Ill.

A second carriage 32 is mounted by a second guide member 34 to the first carriage 20 for translational movement along a second prescribed path T2. Path T2 is preferably normal to the first path T1.

The preferred second guide member 34 is formed as a channel on the first carriage to slidably mount a bolster plate 36 member of the second carriage 32. The guide member is comprised, in a preferred form, of a flat surface 38 on the first carriage, a bridge member 40 rigidly secured to the first carriage, and a side plate 42 rigidly secured to the bridge member. The flat surface 38 is, in the illustrated example, parallel to the side plate 42. The bolster plate 36 of the second carriage 32 is slidably confined between the side plate 42 and the flat surface 38.

The second guide member 34 further includes a pair of parallel elongated guide bars 44 that are mounted between the first carriage and second carriage to define the second prescribed path T2. More specifically the guide bars 44 are situated between the guide member 34 and second carriage. Still more specifically, the preferred guide bars are located between the flat surface 38 on the first carriage, and a facing surface 46 of the bolster plate 36 on the second carriage.

The preferred guide bars 44 are formed of low friction material. Dowels of molybdimum impregnated nylon has been found particularly useful for the rod material. A pair of guide bar engaging members 48 are provided on the other one of the second guide member 34 or bolster 36 to receive the bars 44. Such members 48 are preferably formed as grooves in the bolster plate 36 and flat surface 38 of the first carriage, complimentary to the cross-sectional shape of the bars 44. Selected ends of the grooves are closed (as by welding) to prevent escape of the guide bars 44 longitudinally from the guide bar engaging members 48.

Figure 9:
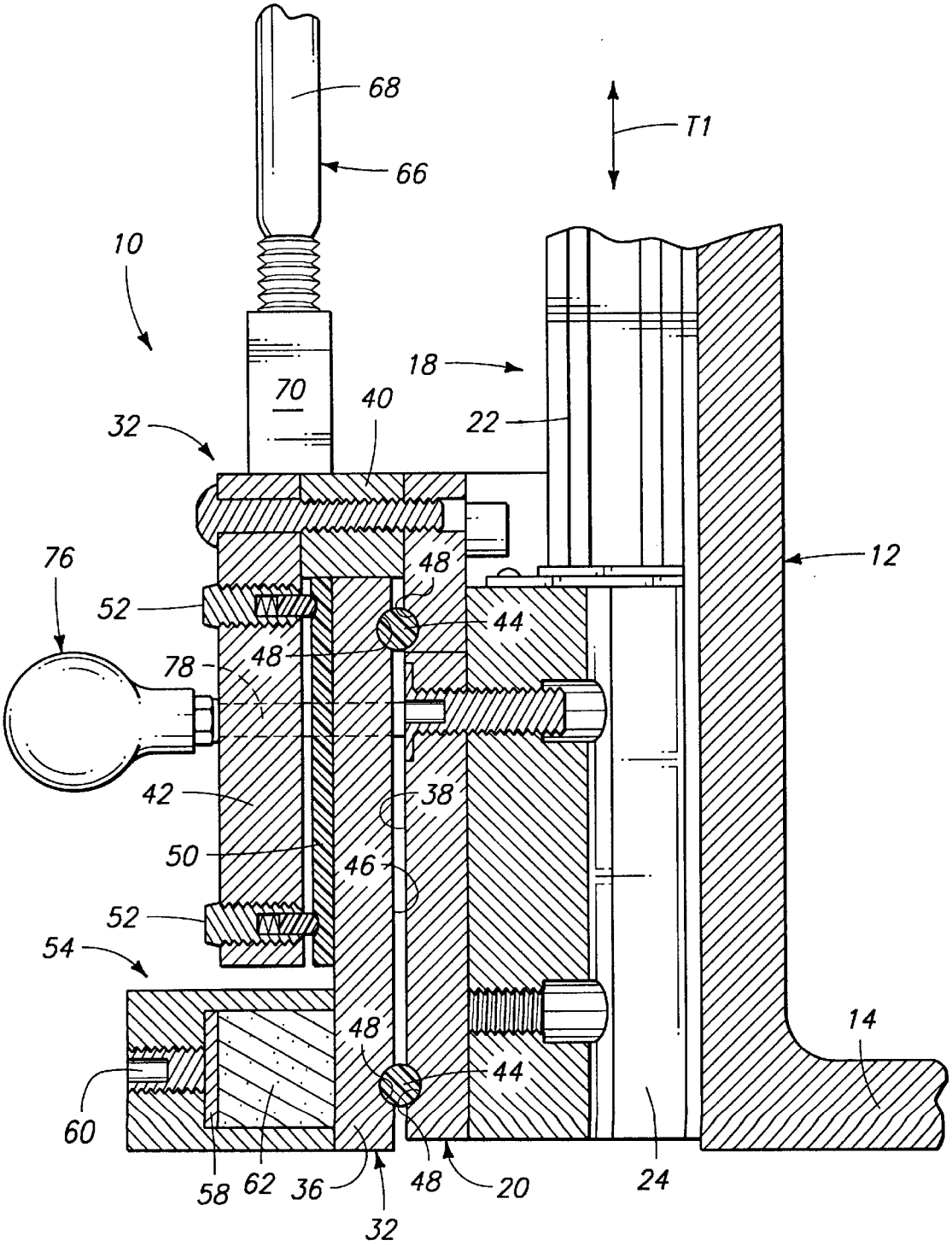
FIG. 9 is an enlarged fragmented sectional view taken along line 9—9 in FIG. 8.
Figure 10:
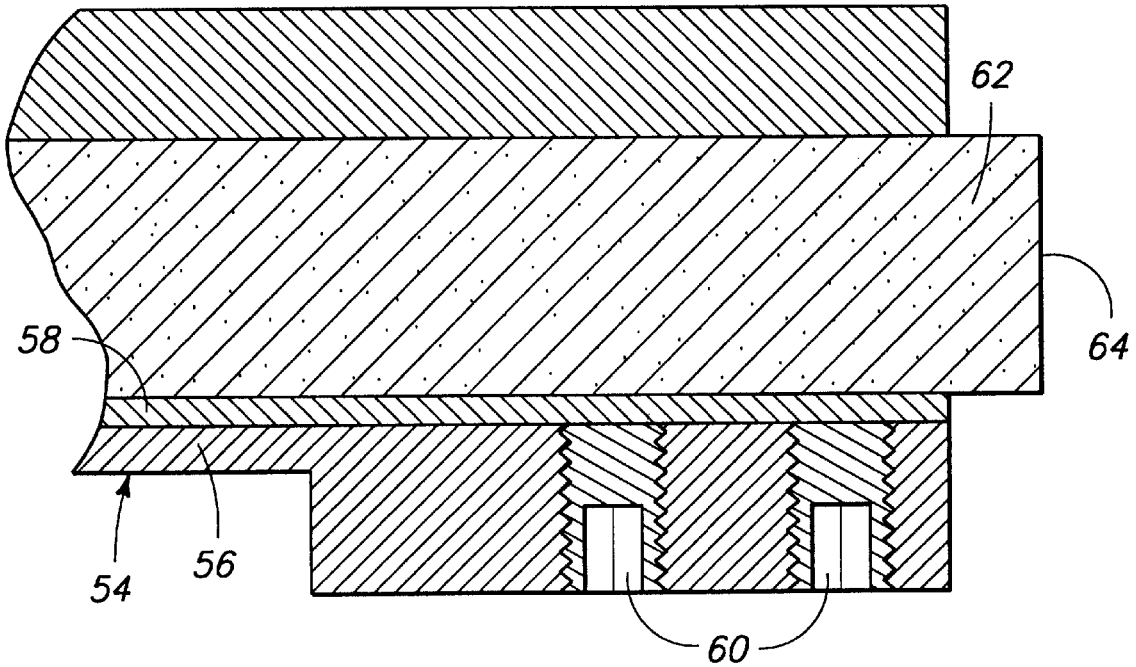
FIG. 10 is an enlarged fragmented sectional view taken along line 10—10 in FIG. 8.

The preferred guide bar engaging members 48 are parallel and are spaced apart as shown in FIG. 9 to provide stability and uniform movable support to the second carriage. The guide bars and bar engaging members also provide secure yet movable positioning of the second carriage relative to the first carriage.

The second guide also includes a bushing plate 50 that slidably engages the bolster plate 36 opposite the guide bars 44. The preferred bushing plate 50 is formed of a low friction plastic material such as ultra high molecular weight polyethylene (UHMW) plastic.

Spring biasing members 52 are advantageously positioned between the bushing plate 50 and the side plate 42 of the second guide. The spring biasing members 52 yieldably urge the bushing plate against the bolster plate and the guide bar engaging members to control translational movement of the second carriage along the second prescribed path T2. There are numerous spring biasing members spaced about the side plate 42, to provide an even, inward force against the bushing plate 50. Thus biased, the bushing plate 50 will also produce a uniform pressure against the bolster plate to firmly yet movably engage the guide bars 44.

Two of the spring biasing members 52 are shown sectioned in FIG. 9. Basically they are hollow screws, threadably engaged with the side plate, and having internal bores that receive compression springs and pin members. The pin members are urged against the bushing plate by the springs, and the spring tension is adjusted by the depth of threaded engagement between the screws and side plate. In a preferred example, the screws are turned to exert a total of approximately 200 lbs against the bushing plate, to firmly seat the bolster plate against the guide bars 44. Yet the low friction nature of the bushing plate and the guide bars 44 will permit motion of the bolster plate along the second path T2 as defined by the bars 44 and complimentary guide bar engaging members 48.

A jointing stone holder 54 is provided on the second carriage. The jointing stone holder 54 includes a sleeve 56 on the bolster plate 36 that is adapted to releasably receive a jointing stone 62. The stone 62 is securely held within the sleeve 56 by a clamping plate 58 that is movably positioned within the sleeve by set screws 60. The set screws 60 threadably engage the sleeve and act against the clamping plate to urge the clamping plate 58 against a jointing stone 62 within the sleeve. The screws 60 can be released to enable sliding adjustment or replacement of the stone within the sleeve. A working end 64 of the stone is exposed for engaging and jointing a rotary cutter blade.

The stone is adjustably positioned during the jointing operation by the first carriage positioner 26 and by an actuator 66 mounted between the first and second carriages 20, 32. The preferred actuator 66 includes a handle 68 with a bellcrank 70 mounted at pitch 72 to the first carriage 20 for pivotal motion about an actuator axis. The bellcrank 70 includes a slotted end 74 slidably receiving a cam follower pin 75 that is mounted to the second carriage 32. The slotted end 74 and cam follower pin 75 are positioned in such a manner that pivotal motion of the handle 68 about the actuator axis will produce resultant motion of the second carriage along the second prescribed path. A rearward pull on the handle will thus result in an outward or forward movement of the second carriage (and jointing stone 62), and a forward push on the handle will result in retraction of the second carriage and stone.

A movement limiting assembly 76 includes motion limiting knobbed pin 78 and arrangement shown in FIG. 9. The knobbed pin 78 extends through holes in the side plate 42, a slot in the bolster plate 36 and becomes threadably engaged in the first carriage. The pin and slot limit the overall total amount of possible travel, for safety purposes, in all directions, of the second carriage along the second path T2.

The movement limiting assembly may also include stroke limiting pins 80, 82 that are connected between the first and second carriages. The pins 80, 82 are provided to permit fine adjustment of the jointing stone position following rough positioning by the actuator 66.

Prior to operation, the present jointer 10 is securely mounted to the framework of the rotary cutter head to be jointed. The jointer can be bolted in place on the framework such that the first path T1 is parallel to the rotational axis of the cutter head, and so the extent of the path spans the axial length of the cutter blades. The jointer is also carefully positioned at this point radially with respect to the cutter head so the cutter knives will intersect the second path T2 within the limitations defined by the movement limiting assembly described above. Operation of the jointer may now be initiated.

If a cylindrical cutter head is to be jointed, with cutter knives that are parallel to the cutter head axis, preliminary adjustments of the motion limiting assembly are made so the stone can be roughly positioned by the actuator, then finally adjusted against the knives by the motion limiting assembly. When preferred adjustments are made the stone can be set using the movement limiting assembly against the rotating knives, jointing the leading knife edges. The hand wheel 29 of the first carriage positioner 26 may now be rotated to move the stone axially along the first path parallel to the rotating knives, jointing the knives along their axial dimensions. The stone will be held securely in the adjusted position without chatter or vibration.

If a pattern cutter head is to be jointed, the positioner and actuator may both be used in "plunge" fashion, using the positioner hand wheel 29 to move the stone axially along the cutter head, then "plunging" the stone into the pattern by use of the actuator and movement limiting assembly at select axial locations along the cutter head according to the cutter shape.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A rotary cutter head knife jointer, comprising:

a rigid base;

a first carriage;

a first guide mounting the first carriage to the rigid base for translational movement along a first prescribed path;

a second carriage movably mounted to the first carriage;

a jointing stone holder;

a bolster plate member on the second carriage mounting the jointing stone holder;

a second guide member mounting the bolster plate to the first carriage for translational movement along a second prescribed path;

wherein the second guide member includes:

guides mounted between the first carriage and second carriage, defining the second prescribed path;

guide engaging members mounted to one of the first carriage or second carriage enabling motion of the second carriage along the second prescribed path;

a bushing plate slidably engaging the bolster plate;

wherein the bushing plate includes a planar bolster plate engaging surface and an opposite surface; and spring biasing members positioned between the bushing plate and second guide member wherein the spring biasing members engage the opposite surface of the bushing plate and urge the bushing plate against the bolster plate in a direction normal to the bolster plate to guide translational movement of the second carriage along the second prescribed path.

2. A rotary cutter head knife jointer, as defined by claim 1 wherein the bushing plate is formed of a low friction plastic material.

3. A rotary cutter head knife jointer, as defined by claim 1 wherein the guides are formed of low friction material.

4. A rotary cutter head knife jointer, as defined by claim 1 wherein the guides are carried in complimentary guide engaging members formed in the bolster plate and first carriage.

5. A rotary cutter head knife jointer, as defined by claim 1 wherein the jointing stone holder includes a sleeve adapted to releasably receive a jointing stone, the sleeve being rigidly secured to the second carriage; and a clamping plate within the sleeve, selectively operable to secure the jointing stone to the sleeve.

6. A rotary cutter head knife jointer, as defined by claim 1 wherein the jointing stone holder includes a sleeve on the bolster plate, adapted to releasably receive a jointing stone;

a clamping plate within the sleeve; and set screws threadably engaging the sleeve and acting against the clamping plate to urge the clamping plate against a jointing stone within the sleeve.

7. A rotary cutter head knife jointer, as defined by claim 1 wherein the first guide is comprised of an elongated column and a linear bearing movably mounted on the elongated column; and wherein the first carriage is mounted to the linear bearing.

8. A rotary cutter head knife jointer, as defined by claim 1 further comprising a first carriage positioner connected between the rigid base and first carriage and operable to selectively position the first carriage along the first prescribed path.

9. A rotary cutter head knife jointer, as defined by claim 1 wherein the first guide is comprised of an elongated column and a linear bearing movably mounted on the elongated column;

wherein the first carriage is mounted to the linear bearing;

and further comprising a first carriage positioner connected between the rigid base and linear bearing and operable to selectively position the first carriage and linear bearing along the first prescribed path.

10. A rotary cutter head knife jointer, as defined by claim 1 further comprising a first carriage positioner connected between the rigid base and linear bearing and operable to selectively position the first carriage and linear bearing along the first prescribed path; and wherein the first carriage positioner is comprised of a lead screw and nut, the lead screw being rotatably mounted to the rigid base, and the nut being attached to the first carriage such that rotation of the lead screw produces resultant linear movement of the nut and first carriage along the first prescribed path.

11. A rotary cutter head knife jointer, as defined by claim 1 further comprising a first carriage positioner connected between the rigid base and linear bearing and operable to selectively position the first carriage and linear bearing along the first prescribed path; and wherein the first carriage positioner is comprised of a lead screw and a recirculating ball bearing nut, the lead screw being rotatably mounted to the rigid base, and the recirculating ball bearing nut being attached to the first carriage such that rotation of the lead screw produces resultant linear movement of the nut and first carriage along the first prescribed path.

12. A rotary cutter head knife jointer, as defined by claim 1 further comprising an actuator mounted between the first and second carriages and selectively operable to move the second carriage along the second prescribed path.

13. A rotary cutter head knife jointer, as defined by claim 1 further comprising an actuator including a handle with a bellcrank pivotally mounted to the first carriage for pivotal motion about an actuator axis;

wherein the bellcrank includes a slotted end slidably receiving a pin mounted to the second carriage and positioned in such a manner that pivotal motion of the handle about the actuator axis will produce resultant motion of the second carriage along the second prescribed path.

14. A rotary cutter head knife jointer, comprising:

a rigid base;

a first carriage;

a first guide mounting the first carriage to the rigid base for translational movement along a first prescribed path;

wherein the first guide includes an elongated column secured to the rigid base and a linear bearing movably mounted on the elongated column;

wherein the first carriage is mounted to the linear bearing;

a first carriage positioner connected between the rigid base and linear bearing and operable to selectively position the first carriage and linear bearing along the first prescribed path;

wherein the first carriage positioner is comprised of a lead screw and a recirculating ball bearing nut, the lead screw being rotatably mounted to the rigid base, and the recirculating ball bearing nut being attached to the first carriage such that rotation of the lead screw produces resultant linear movement of the nut and first carriage along the first prescribed path;

a second carriage;

a jointing stone holder on the second carriage;

a bolster plate member on the second carriage;

a second guide member mounting the second carriage to the first carriage for translational movement along a second prescribed path;

wherein the second guide member includes:

a pair of parallel elongated guide bars mounted between the second guide and bolster plate, defining the second prescribed path;

a pair of guide bar engaging members mounted to one of the second guide or bolster;

a bushing plate slidably engaging the bolster plate;

spring biasing members operably positioned between the bushing plate and second carriage, yieldably urging the bushing plate against the bolster plate and the guide bar engaging members and guide bars to guide translational movement of the second carriage along the second prescribed path;

an actuator including a handle with a bellcrank pivotally mounted to the first carriage for pivotal motion about an actuator axis; and wherein the bellcrank includes a slotted end slidably receiving a pin mounted to the second carriage and positioned in such a manner that pivotal motion of the handle about the actuator axis will produce resultant motion of the second carriage along the second prescribed path.

15. A rotary cutter head knife jointer, as defined by claim 14 wherein the bushing plate includes a planar bolster plate engaging surface and an opposite surface; and wherein the spring biasing members engage the opposite surface of the bushing plate and urge the bushing plate against the bolster plate in a direction normal to the bolster plate.

16. A rotary cutter head knife jointer, as defined by claim 14 wherein the guide bars are spaced apart from one another and are received within complimentary guide engaging members formed in the bolster plate and first carriage.

17. A rotary cutter head knife jointer, as defined by claim 14 wherein the guide bars are formed of low friction material.

18. A rotary cutter head knife jointer, as defined by claim 14 wherein the guide bars are carried in complimentary parallel guide bar engaging members formed in the bolster plate and first carriage.

19. A rotary cutter head knife jointer, as defined by claim 14 wherein the jointing stone holder includes a sleeve adapted to releasably receive a jointing stone, the sleeve being rigidly secured to the second carriage.

* * * * *